US008132284B1

(12) United States Patent
Kraemer

(10) Patent No.: US 8,132,284 B1
(45) Date of Patent: Mar. 13, 2012

(54) TOOTHBRUSH

(75) Inventor: Hans Kraemer, Buehl (DE)

(73) Assignee: GlaxoSmithKline Consumer Healthcare GmbH & Co., Buehl (Baden) (DE)

( * ) Notice: Subject to any disclaimer, the term of this patent is extended or adjusted under 35 U.S.C. 154(b) by 0 days.

(21) Appl. No.: 09/958,640

(22) PCT Filed: Apr. 6, 2000

(86) PCT No.: PCT/IB00/00576

§ 371 (c)(1),
(2), (4) Date: Mar. 15, 2007

(87) PCT Pub. No.: WO00/60980

PCT Pub. Date: Oct. 19, 2000

(30) Foreign Application Priority Data

Apr. 9, 1999 (GB) ..... 9907996.4

(51) Int. Cl.
*A46B 7/06* (2006.01)
*A46B 9/04* (2006.01)

(52) U.S. Cl. ..... 15/167.1; 15/201

(58) Field of Classification Search ..... 15/167.1, 15/187, 201
See application file for complete search history.

(56) References Cited

U.S. PATENT DOCUMENTS

| | | | | |
|---|---|---|---|---|
| 3,798,699 | A | | 3/1974 | Lewis |
| 4,633,542 | A | | 1/1987 | Taravel |
| 5,454,133 | A | | 10/1995 | Garnet |
| 5,483,722 | A | | 1/1996 | Scheier et al. |
| 5,511,274 | A | * | 4/1996 | Lewis, Jr. ..... 15/160 |
| 5,967,617 | A | * | 10/1999 | Zapanta ..... 300/21 |
| 6,088,870 | A | * | 7/2000 | Hohlbein ..... 15/167.1 |

FOREIGN PATENT DOCUMENTS

| | | | |
|---|---|---|---|
| DE | 41 22 524 | | 7/1992 |
| DE | 195 42 393 | * | 5/1997 |
| WO | WO 92 17093 A | | 10/1992 |
| WO | WO 93/24034 | | 12/2003 |

* cited by examiner

*Primary Examiner* — Randall Chin
(74) *Attorney, Agent, or Firm* — Joshua C. Sanders; Nora L. Stein; Theodore R. Furman

(57) ABSTRACT

A toothbrush in which at least some of the bristles are linked together at their ends proximate to the head by a web in the toothbrush head, with a pad of a resilient elastomeric material adjacent to the web. When pressure is applied to the bristles this pressure is communicated to the web, and the web bears upon the pad, and communicates the pressure to the pad of elastomeric material. By the toothbrush excessive pressure between the teeth and the bristles during toothbrushing may be relieved.

11 Claims, 3 Drawing Sheets

TOOTHBRUSH

This invention relates to toothbrushes, in particular to toothbrushes having flexibly mounted bristles.

Toothbrushes are known having the ends (the "proximate" end) of their bristles which are fixed into the head flexibly mounted in contact with a resilient elastomeric material membrane. For example U.S. Pat. No. 4,633,542 discloses a toothbrush where the ends of individual tufts are moveably mounted with their proximate ends in contact with a flexible membrane. WO 93/24034 discloses a power-operated toothbrush in which the ends of individual tufts are mounted with their proximate ends in cavities in a flexible membrane. U.S. Pat. No. 5,454,133 discloses a toothbrush in which the proximate ends of individual tufts are mounted in contact with a flexible pad or a capsule containing a very soft gel or liquid. DE 41 22 524 A discloses a toothbrush in which the proximate ends of bristles are mounted on a plate, the reverse side of which is in contact with a spring.

There is a problem with anchoring the bristles in such toothbrushes. In U.S. Pat. No. 4,633,542 the bristle tufts have their ends proximate to the head fused into rounded masses which are simply in contact with the membrane. In WO 93/24034 the proximate ends of the bristles are again formed into rounded masses which are held in cavities in the membrane. In U.S. Pat. No. 5,454,133 the bristle tufts have their proximate ends fastened to a rubber base which is attached to the outer surface of the pad or capsule.

It is an object of this invention to provide a toothbrush in which the bristles are flexibly mounted on a flexible pad in the head which overcomes in part at least the problems encountered with the above-mentioned toothbrushes of the state of the art. Other objects and advantages of the present invention will be apparent from the following description.

According to this invention a toothbrush is provided which has a head and a handle, with a neck region between the head and handle all arranged along a longitudinal toothbrush axis, the head having bristles projecting from it in a bristle direction generally perpendicular to the longitudinal axis, the bristles having ends proximate to the head and ends distanced from the head.

characterised by at least some of the bristles being linked together at their ends proximate to the head by a web which is incorporated into the toothbrush head, the head incorporating a pad of a resilient elastomeric material adjacent to the web such that when pressure is applied to the bristles this pressure is communicated to the web, and such that the web bears upon the pad, and communicates the pressure to the pad of elastomeric material.

The invention makes possible a toothbrush having a desirable "waterbed" like flexibility of the tufts in the toothbrush head.

At its end closest to the head the handle may be formed into a neck region located between the head and the part of the handle which is gripped by the user of the toothbrush.

The ends of the bristles which are closest to the head are termed the "proximate" ends of the bristles.

The bristles of the toothbrush of this invention may be made of any material that is at present used for toothbrush bristles, for example nylon monofilaments of diameter ca. 0.10-0.75 mm, such as those commercially available from DuPont™ under the name DuPont Tynex™, made from Nylon 612. The bristles may project in a bristle direction substantially perpendicular to the longitudinal axis of the toothbrush, but may alternatively be angled to the vertical.

The bristles may be present in the toothbrush of the invention in the form of individual single filaments, that is in a "mat" of a large number of individual filaments, for example distributed substantially uniformly over a substantial area of the face of the toothbrush head from which the bristles project.

Alternatively and preferably the bristles may be distributed in a pattern of a plurality of discrete tufts each containing a plurality of bristle filaments, for example 5-100, preferably 10-75, e.g. 30-60 bristles per tuft. Such tufts may for example be of circular or non-circular cross section. The proximate ends of the bristles in individual tufts are preferably joined together, and the proximate ends of individual tufts being linked to the web. The proximate ends of bristles in tufts may for example be joined together by the known process of melting the proximate ends into a mass of melted bristle material and subsequently allowing the melted mass to cool and solidify. Such a melting process is used in so-called "anchorless" bristle toothbrushes.

The bristles or tufts are preferably linked together at their ends proximate to the head by the web by means of the proximate ends of the bristles or tufts being attached to the web. Some or all of the bristles, or tufts of bristles, are linked by the web. For example all of the bristles or all of the tufts may be linked by the web. Alternatively the toothbrush may include a plurality of independent groups of tufts of bristles in each of the groups the proximate ends of the tufts are linked by respective independent webs.

The web typically comprises a flexible, substantially 2-dimensional structure linking the proximate ends of the bristles, or tufts, and extending generally in and across the longitudinal axis direction. The web may be a flexible and/or resilient structure. There may be a single web linking all of the tufts or bristles, or a plurality of separate webs each respectively linking independent groups of tufts of bristles.

For example the web may comprise a thin, flexible sheet of a material to which the proximate ends of the bristles are attached. The sheet may be a completely closed sheet or may alternatively be perforated with one or more holes passing through the sheet. For example the web may be in the form of a lattice, network or mesh defined by threads of the web material, and the proximate ends of the bristles or tufts may be attached at the junctions of the lattice, network or mesh. The web, whether a sheet or a lattice, network or mesh may be substantially planar, in a plane substantially parallel to the longitudinal axis of the toothbrush and substantially perpendicular to the bristle direction. Alternatively the sheet may be undulating, for example in a curved wave, zig-zag or square wave profile.

The sheet, lattice, network or mesh may be made of any convenient material to which the proximate ends of the bristles may be attached. Suitable materials include metals, and preferably plastics materials.

Suitably the bristles may be attached to the web by means of an adhesive, a mechanical fastening or preferably by fusion welding in which case the web is preferably made of a material to which the proximate ends of the bristles may easily weld, for example a plastics material, e.g. a nylon polymer. Such a nylon polymer may for example comprise the same nylon polymer as the bristles.

Typically for example the bristles may be attached to such a web by bundling the bristles together, either in the form of such a "mat" of single filaments or in the form of discrete tufts, optionally fusing the proximate ends into a mass of fused bristle material, holding the bundle and respectively the web mechanically in a suitable jig, and bringing the ends of the bristles into contact with a surface of the web, and heating the contact region of the bristles and the web such that the material of the bristles and the web fuses together in a weld.

Electrical induction welding or ultrasonic welding may for example be used for fixing the bristles to the web in this way.

In an alternative procedure the web may be formed in situ by a process of moulding, e.g. injection moulding, in which the web is formed around the proximate ends of the bristles or tufts. Such a web may be made by for example a process which comprises:

arranging the bristles or tufts into an array corresponding to the pattern of all or part of the pattern of the bristles or tufts on the head of the toothbrush;

enclosing the parts, e.g. the proximate ends, which are to be fixed into the head in a suitable mould cavity which defines the position and dimensions of the web to be formed, e.g. the sheet or the network;

introducing, e.g. injecting, a plastics material into the mould cavity to thereby form the web around the proximate ends of the bristles or tufts;

and then allowing the plastics material to cool and solidify and thereby form the web.

The plastics material is suitably one which bonds to the material of the bristles. Suitable plastics materials and conditions to achieve bonding are known in the art. For example processes are known in which bristles are inserted into a mould cavity through insertion openings, and plastics materials is injected into the mould cavity to thereby form an entire head around the proximate ends of the bristles and bonded by welding with these proximate ends. The plastics material of the web formed in this last mentioned process may for example be a material from which plastic toothbrush heads are made, or from which the bristles are made.

Preferably the web is made integrally of the same material as the bristles. The web of a toothbrush of this last-mentioned type may be formed by melting the part of the bristles which is to be fixed into the head, e.g. the proximate ends of a number of the bristles or of the tufts, and causing the melted material of the bristles or tufts to flow in a direction generally perpendicular to the bristle direction so that melted material from one bristle or tuft merges with that from neighbouring bristles or tufts to form a web in the form of a sheet, lattice, network or mesh of threads, of melted material which is then allowed to solidify to result in a web which is integral with the bristles.

Such an integral web may be made by for example a process which comprises:

arranging the bristles or tufts into an array corresponding to the pattern of all or part of the pattern of the bristles or tufts on the head of the toothbrush;

enclosing the parts, e.g. the proximate ends, which are to be fixed into the head in a suitable mould cavity having one or more channels linking the parts, the one or more channels defining the position and dimensions of the web to be formed, e.g. the sheet or the network;

then heating and if necessary compressing the parts so that the bristle material melts and runs together through the channel(s) to thereby form the web;

and then allowing the melted material to cool and solidify and thereby form the web.

Such a web consequently comprises a flexible sheet or a network of threads, made of the bristle material, which links the proximate ends of a plurality of the bristles or the tufts.

Such a lattice, network or mesh may be in the form of a rectilinear grid, i.e. with square or rectangular spaces, or of other geometries, for example having triangular, parallelogram shaped, hexagonal or other polygonal etc. spaces between the solid threads of the web. Typically the bristles or tufts will be located at the junctions of the solid threads of such a web, but additionally or alternatively they may be located along the threads between junctions.

The web, however it is provided, is suitably flexible under the influence of pressure applied to the toothbrush bristles in the bristle direction, i.e. under the action of toothbrushing. Such flexibility may be achieved by suitable materials and dimensions. Typically the web, whether in the form of the above described separately provided sheet or made integrally of the bristle material may be of a thickness up to 1 mm, e.g. 0.01-0.5 mm. When the web comprises the above-described lattice, network or mesh the treads may have a cross section, i.e. across the length dimension of the threads defined as the length between junctions of the threads, of up to 1 mm. e.g. 0.01-0.5 mm. The dimensions of the sheet or thread may be determined experimentally on the basis of the desired flexibility of the web and the materials of which it is made. The dimensions of the sheet or network may be uniform over the web, or the dimensions may differ in different places, e.g. to provide different flexibility at different parts of the web. The web may for example comprise parts which are a sheet and parts which are a network.

The pad of elastomeric material may typically be in the form of a flexible, resilient elastomeric pad, block or membrane extending generally in and across the longitudinal axis direction. The web may be adjacent to a surface of the pad, for example on a side of the pad which faces in the bristle direction. Preferably the web is in contact with the pad, for example bonded to the pad. In a preferred construction the web is embedded in the pad, such that the bristles extend from the web through a thickness of the pad material above the web, and out of the pad in the bristle direction. For example the web may be located approximately mid way through the thickness of the web. In these constructions there is consequently a thickness of the pad material below the web, so that pressure can be communicated from the bristles to the web and via the web to the pad.

The term "elastomeric" as used herein includes any polymeric material with rubber-like characteristics, that is typically deforming under compressive pressure and returning rapidly, e.g. bouncing back, to or close to its original shape on the removal of such compressive pressure. The elastomeric material may be of any elastomeric material which is compatible with the web and bristle material and is suitable for use in a toothbrush head. A function of the elastomeric pad is to relieve excessive pressure between the bristles and the user's teeth and gums during use of the toothbrush in toothbrushing. Consequently the elastomeric material may have a hardness of Shore A 5 to A 80. Suitable elastomeric materials are synthetic rubbers, butyl rubbers, ethylene rubbers, propylene rubbers, silicone rubbers, ethylene vinyl acetate copolymers, plasticised PVC, or compounds based on styrene block copolymers such as styrene-ethylene-butadiene (or propylene)-styrene ("SEB(or P)S"), or compounds based on styrene-isoprene (or butadiene)-styrene (SI(B)S) such as Thermolast K™ (supplied by Kraiburg Gummiwerk GmbH & Co (DE)).

If the elastomeric material is sufficiently soft then pressure applied to one region of bristles may be communicated through the elastomeric material pad to other regions of the bristles, so that as the region of bristles to which pressure is applied sinks into the pad under the pressure another region rises. This can give an advantageous cleaning and massaging effect to the toothbrush of the invention.

Webs and elastomeric pads of the above-described construction may be incorporated in the head of the toothbrush of the invention in various ways.

In one way a cavity may be provided in the head of the toothbrush which can receive the web and pad. Such a cavity may be open on the side of the head which faces in the bristle direction, so that the pad is exposed to the outside environment of the toothbrush. Alternatively the cavity may be closed e.g. by an enclosing wall of plastics material, e.g. having apertures therein for the bristles to extend through. In such a construction the shape and dimensions of the pad may correspond generally to that of the cavity and the shape and dimensions of the web may correspond generally to the pad.

In one construction of the toothbrush head of the invention when the head has a cavity which receives the pad and web, beneath the pad, i.e. on the opposite side of the pad from that which faces the bristle direction, there may be a void between this opposite side of the pad and a back wall of the head which wholly or partly closes the cavity. Such a void may enhance the flexibility of the pad by allowing the pad to deform flexibly into the void. In such a construction there may be support ribs or feet between the pad and this back wall to support the pad and modify its flexibility. These ribs or feet may for example be integrally formed of the material of the back wall or the pad. Such ribs or feet may be located at points directly beneath the proximate ends of the bristle tufts, or otherwise, for example the proximate ends of the bristles or tufts may be located between such feet or ribs.

The elastomeric pad may conveniently be made by a process of injection moulding, particularly if the elastomeric material is a thermoplastic material such as the Thermolast KT™ material referred to above. When such a process is used, the construct of the web and bristles or tufts may be made first, and this construct may be inserted into a mould cavity into which the elastomeric material is then injected. By selection of appropriate materials for the web and elastomeric material the web may be caused to be embedded within the pad, and/or may be caused to bond with the pad. Suitable processes for injection of elastomeric material and bonding it to the type of material discusses above for the web and bristles are known in the art. In an injection moulding process of this type the web may be completely or partly embedded in and enclosed by the pad.

The pad and web may be fixed into the head of the toothbrush in various ways. In one way the web and/or pad (particularly if the pad has been formed by injection moulding with the web embedded or enclosed in it) may be inserted in an injection mould cavity in which the head is to be formed, and the head may be moulded around the pad and/or web, with moulding conditions preferably being selected so that the web and/or pad bond with the head material. In such a process the injection moulding conditions may be selected such that the materials of the head and the pad bond together. Suitable processes for injection of plastics material and bonding it to the type of material discusses above for the pad are known in the art. Additionally or alternatively the web may extend outside of the pad and the web may be provided with one or more holders, e.g. wings or other structures which may engage the toothbrush head and thereby fix the web into the head. Alternatively the toothbrush head may be made with a cavity in which the pad and web may fit, and a closure is then used to close the cavity and to hold the web and pad in place in the head. Various other ways of fixing such a pad and web into the toothbrush head will be apparent to those skilled in the art.

Other parts of the toothbrush for example the toothbrush handle may be of known construction, for example incorporating one or more "S" bends as disclosed in EP 0 836 641-A. Additionally or alternatively the toothbrush may incorporate flexible links at other places in its structure.

Suitable plastics materials from which the head and handle toothbrush of the invention may be made includes plastics material such as known plastics materials which are used in the manufacture of two-component toothbrushes in which the plastics material is bonded to a second, elastomeric material, component. Known injection moulding processes may be used to make the toothbrush of the invention from such plastics materials and elastomeric materials.

As a further aspect the invention provides a mould suitable for making therein the web, construct of web and tufts or bristles, an elastomeric pad, or a toothbrush head of a toothbrush as described herein. Such a mould may be an injection mould, either hot or cold runner.

As a further aspect the invention therefore provides an injection moulding process by means of which the toothbrush of the invention is made.

As a yet further aspect the invention provides an injection mould or moulds for use in such a process.

An advantage of the toothbrush of the invention is that excessive pressure between the teeth and the bristles during toothbrushing may be relieved as it is communicated to the pad of elastomeric material, e.g. in a "waterbed" effect. Another advantage is that the attachment of the bristles to the elastomeric pad is enhanced by the use of the web, as this can improve the anchoring of the bristles into the pad. The web also provides the advantage that the bristles are linked by the web, so that pressures experienced by localised regions of the bristle field can be transmitted to other parts of the bristle field, assisting in the relief of excessive brushing pressure between the bristles and teeth.

The invention will now be described by way of example only with reference to the accompanying drawings in which.

Figure 1:
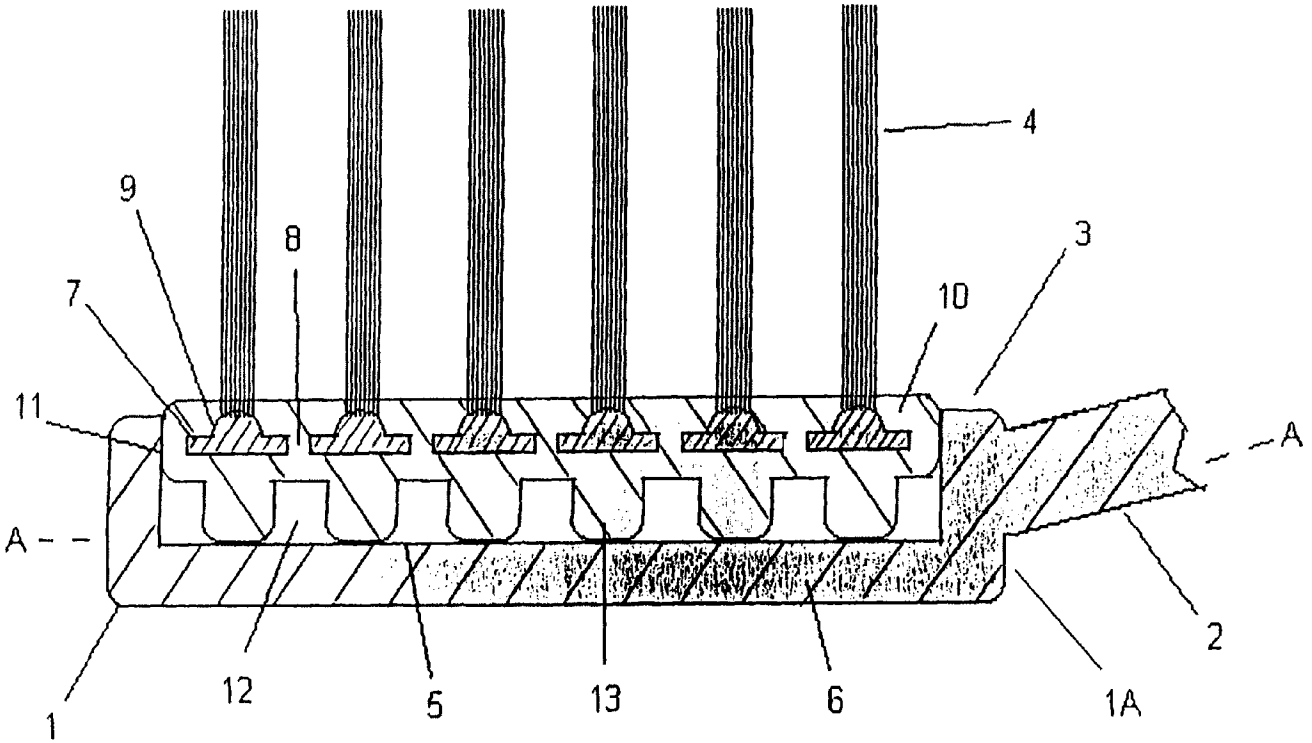
FIG. 1 shows a longitudinal section through a toothbrush head of this invention.
Figure 2:
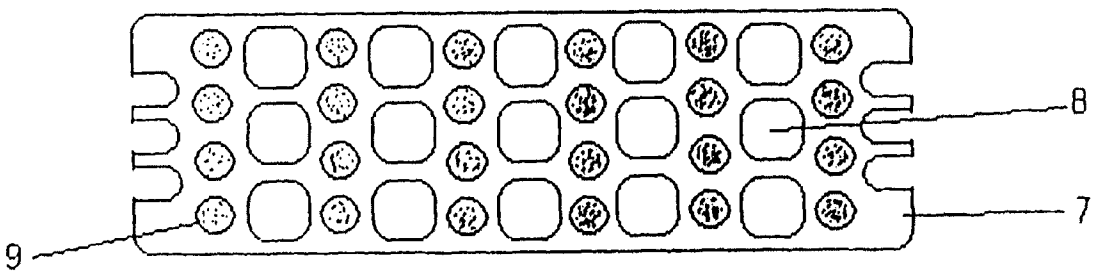
FIG. 2 shows a plan view of the web and bristle tufts of the toothbrush head of FIG. 1.

Referring to FIGS. 1 and 2, the head 1 of a toothbrush of the invention is shown, being of elongate shape and integrally joined at one longitudinal end lA to a grip handle 2. The head 1 and handle 2 are arranged on a longitudinal axis A-A. The head 1 and handle 2 are integrally made of plastic material. From a front face 3 of the head 1 bristles 4 project in a bristle direction. The bristles 4 are disposed in a pattern of discrete tufts of generally circular cross section across the bristle direction. In the head 1 is a cavity 5, which is open on the side facing in the bristle direction but on the opposite side is closed by a back surface 6 of the head 1. The bristles 4 as shown in FIG. 2 are arranged in a rectilinear grid pattern but may of course be disposed in alternative patterns to that shown.

At the ends of the bristles 4 proximate to the head 1 is a web 7. The web 7 is in the form of a thin sheet of polymeric material, for example made of the same nylon material as the material of the bristles 4. The web 7 is of generally elongate shape corresponding generally to the shape and dimensions of the cavity 5. The web 7 is perforated by a number of holes 8. The proximate end of each tuft of the bristles 4 is fixed to the web 7 by a spot weld 9. This has been achieved by bundling the bristles 4 together in bundles corresponding to the pattern of tufts to be formed, holding the bundles in a holding jig, bringing the proximate ends into contact with the web 7 and applying heating, preferably locally at the points where the proximate ends contact the web 7, and thereby forming the spot welds 9. In the tufts the bristles 4 consist of fibres having a fibre end at the proximate end. The web 7 is embedded and wholly enclosed in an elastomeric material pad 10 made of a soft, flexible, resilient thermoplastic elastomeric material, so that there is a thickness of elastomeric material both above the web 7 (i.e. facing in the bristle direction) and below the web 7 (i.e. facing the back surface 6 of the cavity 5. The pad 10 corresponds in plan closely to the shape and dimensions of cavity 5, and fits into the cavity 5, forming a tight seal against the sides 11 of the cavity 5, where the pad 10 is fixed tightly to the sides 11 of the cavity. Beneath the pad 10, i.e. between the pad 10 and the back wall 6 of the cavity 5 is a void 12. The lower surface of the pad 10 is formed integrally into support feet 13, in the form of generally cylindrical bulges which contact the back wall. As shown in FIG. 1 the bristles 4 are mounted in the pad 10 at positions above the support feet 13, but they could of course be mounted in positions between the feet 13.

Figure 3:
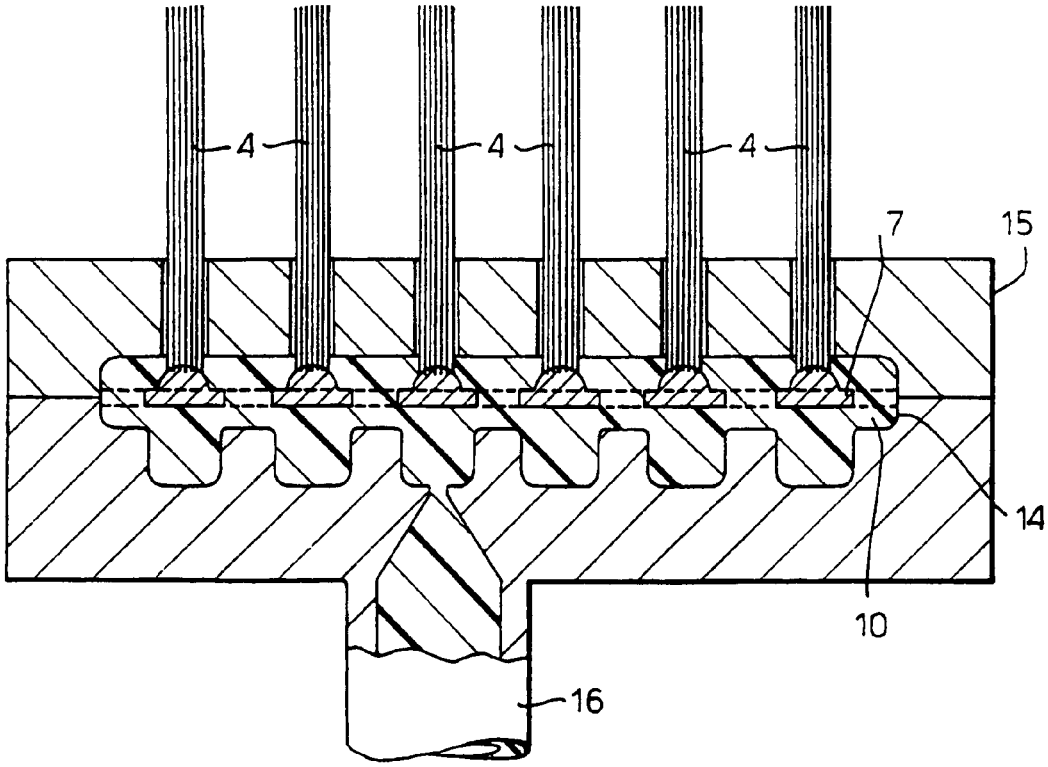
FIG. 3 shows a cross section through a mould for making the web of FIGS. 3 and 4.

Referring to FIG. 3 the web 7 with its attached bristles 4 is embedded in the pad 10 by first making the web 7 and bristles 4 unit, then positioning this unit in the cavity 14 of an injection mould 15. The cavity 14 defines the shape and dimensions of the pad 10 to be formed. Elastomeric material is then injected into this mould cavity 14 via port 16 to form the pad 10, with the web 7 plus bristles 4 unit embedded therein, and the bristles 4 projecting from it. The pad 10 plus web 7 plus bristles 4 unit is then be incorporated into the toothbrush head 1 by insertion and fixing into the cavity 5.

In use, when the toothbrush of FIG. 1 is applied to the teeth, pressure on a tuft of bristles 4 is communicated to web 7, and hence to the other tufts of bristles 4, and to the pad 10 thereby spreading and relieving the pressure between the bristles 4 and user's teeth.

Figure 6:
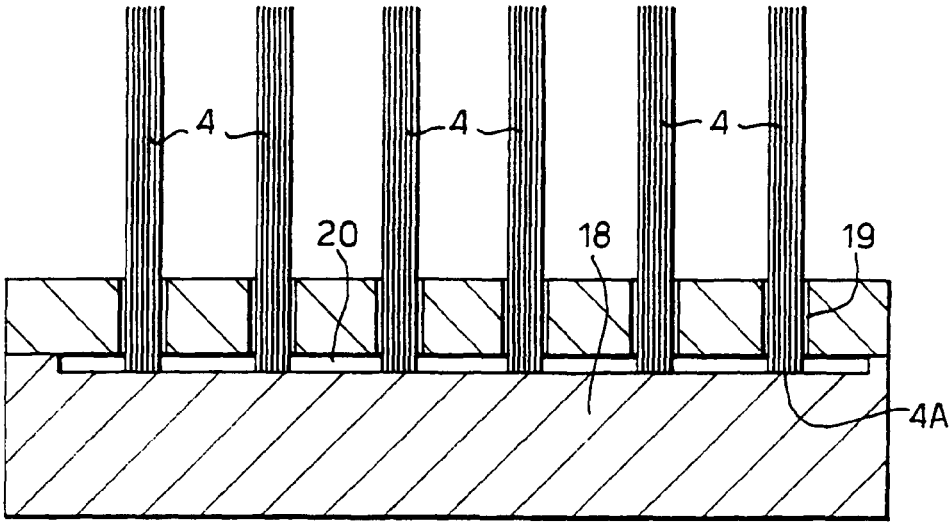
FIG. 6 shows a cross section through a mould for making the web plus pad structure of the toothbrush head of FIGS. 1 and 2.
Figure 7:
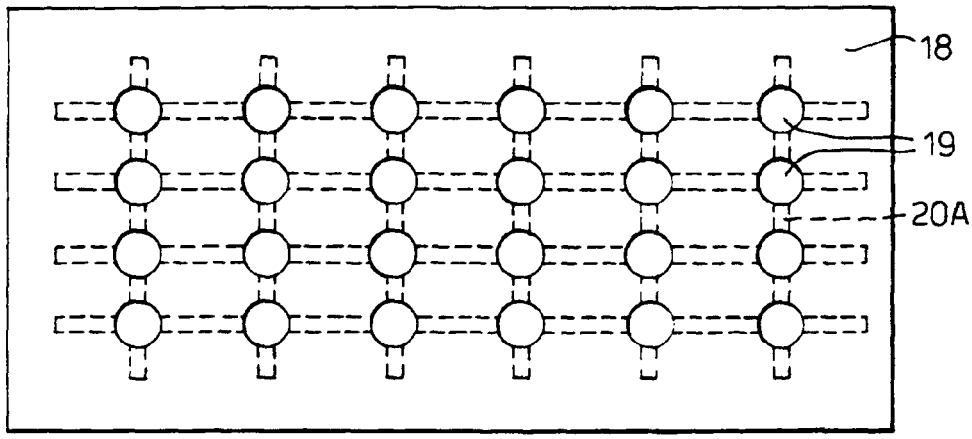
FIG. 7 shows a plan view of the mould of FIG. 6.

Referring to FIGS. 4, 5, 6 and 7 an alternative construction of bristles 4 and a web 17 is shown. The web 17 is in the form of a network of threads 17A of material which is integral with the bristles. This network has been made by inserting the proximate ends of tufts 4 into a two-part injection mould 18 which is provided with insertion channels 19 in its upper part for insertion of the bristles 4, and an internal mould cavity 20 which as shown in plan in FIG. 7 is a network of channels 20A corresponding to the web 17 as seen in plan in FIG. 4. The proximate ends extend into the cavity 20. Though shown in the simplified plan view of the mould 18 FIG. 7 as a rectilinear network of channels 20A, the cavity could alternatively be a single thin, flat cavity to thereby form a web in the form of a thin sheet, or could have other geometries, e.g. to define the web threads 17B.

Figure 4:
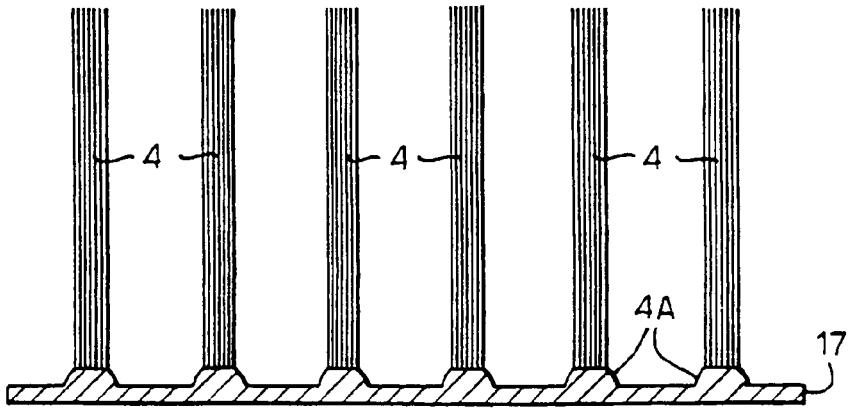
FIG. 4 shows a longitudinal section through an alternative construction of bristle tufts and web.
Figure 5:
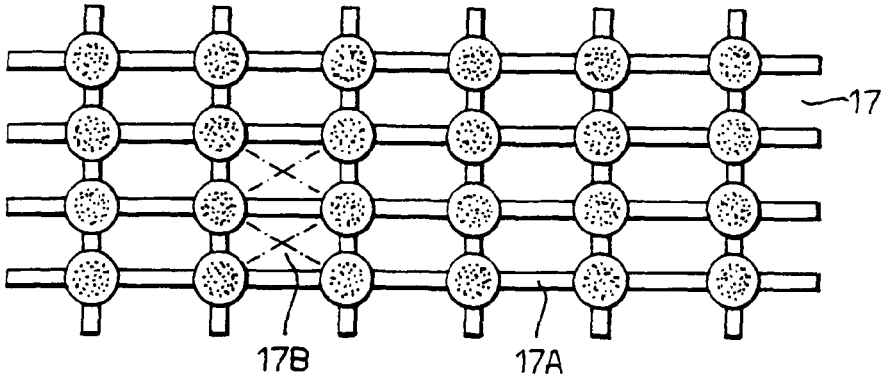
FIG. 5 shows a plan view of the web and bristle tufts of FIG. 3.

With the tufts 4 inserted along the channels 19 in the mould 18 as shown in FIG. 4, the mould 18 is heated to melt the material of the proximate ends of the bristles 4 and pressure is applied if necessary, e.g. compressing the mould parts together or compressing the tufts 4 toward the mould 18, to cause the melted bristle material to flow through the channels 20A of the mould cavity 20 of the mould 18, where it merges to form the web 17. The melted material is then allowed to solidify to result in a solid web 17 which is integral with the bristles 4. The construct of web 17 and tufts 4 is then removed by dissembling the mould 18. The dimensions of the web 17, and hence the dimensions of the cavity 20 are such that the web 17 is flexible.

Although shown in FIG. 4 as a rectilinear grid pattern, the web 17 may have other geometries, for example the links 17A of the web 17 may be aligned diagonally as shown in the broken lines 17B, or in a hexagonal pattern or other polygonal pattern.

Once fabricated, the web 17 plus its integral tufts of bristles 4 may be incorporated in a pad 10, and then the construct of bristle tufts 4 plus web 17 may be incorporated in the cavity 5 of a toothbrush head 1 in a manner analogous to that described above with reference to the web 7 and pad 10 of FIGS. 1 and 2 above.

It will also be appreciated that FIGS. 6 and 7 schematically illustrate a further process for making a web such as 7 having tufts 4 bonded to it. Tufts 4, arranged in an array corresponding to the pattern of the bristles or tufts on the head of the toothbrush have their proximate ends enclosed in a mould cavity 20 which defines the position and dimensions of the web to be formed, e.g. the sheet or the network. The web 7 is then made by injecting a plastics material into the mould cavity 20 via an injection port (not shown) to thereby form the web 7 around the proximate ends 4 of the tufts. The plastics material is then allowed to cool and solidify and thereby form the web. Once fabricated, the web 7 plus its tufts of bristles 4 made in this way may be incorporated in a pad 10, and then the bristle 4 plus web 17 structure may be incorporated in the cavity 5 of a toothbrush head 1 in a manner analogous to that described above with reference to the web 7 and pad 10 of FIGS. 1 and 2 above.

In use, when the toothbrush of FIG. 4 is applied to the teeth, pressure on a tuft of bristles 4 is communicated to web 17, and hence to the other tufts of bristles 4, and to the pad 10 thereby spreading and relieving the pressure between the bristles 4 and user's teeth.

The invention claimed is:

1. A toothbrush head having a longitudinal axis direction, the head having bristles projecting therefrom in a bristle direction generally perpendicular to the longitudinal axis direction, the bristles having ends proximate to the head and ends distanced from the head, characterised by the bristles being linked together at their ends proximate to the head by a web which is incorporated into the toothbrush head, the head incorporating a pad of a resilient elastomeric material, the pad having a thickness dimension in the bristle direction, the web being embedded in the pad and being part way through the thickness of the pad, such that the bristles extend from the web through a thickness of the pad material above the web, and out of the pad in the bristle direction, and there being a thickness of elastomeric material below the web, such that when pressure is applied to the bristles this pressure is communicated to the web, and such that the web bears upon the pad, and communicates the pressure to the pad of elastomeric material.

2. A toothbrush head according to claim 1 characterised in that the bristles are arranged in tufts which are linked together at their ends proximate to the head by the proximate ends of the bristles or tufts being attached to the web.

3. A toothbrush head according to claim 1 characterised in that the web comprises a flexible, substantially 2-dimensional structure linking the proximate ends of the tufts and extending generally in and across the longitudinal axis direction.

4. A toothbrush head according to claim 1 characterised in that the web comprises a sheet of web material.

5. A toothbrush head according to claim 1 characterised in that the web is in the form of a lattice of the web material.

6. A toothbrush head according to claim 1 characterised in that the web is made of plastics materials.

7. A toothbrush head according to claim 1 in which the bristles are attached to the web by fusion welding of the bristles to the web.

8. A toothbrush head according to claim 1 characterised in that the web is made integrally of the same material as the bristles.

9. A toothbrush head according to claim 1 characterised in that the pad of elastomeric material comprises a flexible; and resilient elastomeric pad extending generally in and across the longitudinal axis direction.

10. A toothbrush head according to claim 1 characterised in that a cavity is provided in the head which can receive the web and pad.

11. A toothbrush head according to claim 10 characterised in that beneath the pad, on the opposite side of the pad from that which faces the bristle direction, there is a void between this opposite side of the pad and a back wall of the head which wholly or partly closes the cavity.

* * * * *